US005647522A

United States Patent [19]

Routh

[11] Patent Number: 5,647,522

[45] Date of Patent: Jul. 15, 1997

[54] LOAD CARRYING SYSTEM WITH FRICTION-ENHANCED LOAD CARRYING EMBRASURE

[75] Inventor: Thomas R. Routh, Portland, Oreg.

[73] Assignee: CirqueWorks LLC, Portland, Oreg.

[21] Appl. No.: 559,465

[22] Filed: Nov. 15, 1995

[51] Int. Cl.[6] ..... A45F 3/14

[52] U.S. Cl. ..... 224/651; 224/250; 224/917

[58] Field of Search ..... 224/214 F, 578, 224/579, 580, 651, 250, 917, 601, 602, 603, 650, 637, 638, 639, 645; 294/147, 148, 166, 74

[56] References Cited

U.S. PATENT DOCUMENTS

| | | | |
|---|---|---|---|
| 995,458 | 6/1911 | Harriman | 224/651 |
| 4,052,095 | 10/1977 | Johnson | 294/74 |
| 4,308,982 | 1/1982 | Hall . | |
| 4,350,380 | 9/1982 | Williams | 294/74 |
| 4,790,460 | 12/1988 | Harper, Jr. | 224/250 |
| 4,819,845 | 4/1989 | Byrd . | |
| 4,958,760 | 9/1990 | Mulé et al. . | |
| 4,982,883 | 1/1991 | Ullal et al. . | |
| 5,005,744 | 4/1991 | Gleason . | |
| 5,240,159 | 8/1993 | Gregory | 224/637 |
| 5,344,056 | 9/1994 | Challoner et al. | 224/250 |
| 5,350,096 | 9/1994 | Sieber . | |
| 5,467,907 | 11/1995 | Celik | 224/638 |

FOREIGN PATENT DOCUMENTS

| | | | |
|---|---|---|---|
| 65879 | 12/1982 | European Pat. Off. | 294/74 |
| 612489 A1 | 8/1994 | European Pat. Off. | 224/214 |
| 2 214 104 | 9/1973 | Germany . | |
| 274643 | 4/1951 | Sweden | 224/214 |

OTHER PUBLICATIONS

Lift–All Slings by LiftAll; general catalog GC70; emphasis on p. 4 which discloses treating straps with a TRX coating 1969.

*The BeaverTail Shovit,* Dana Design Catalogue, p. 31 No Date Given, Estimated 1993.

*Primary Examiner*—Henry J. Recla
*Assistant Examiner*—Gregory M. Vidovich
*Attorney, Agent, or Firm*—Kolisch, Hartwell, Dickinson, McCormack & Heuser

[57] ABSTRACT

A user borne load carrying system comprising a support structure that is securable to, or otherwise carryable by, a user, and a retention mechanism to secure a load to the support structure. The retention mechanism includes a girth-like embrasure of friction enhancing material adapted to encircle the load. The retention mechanism further includes an adjustment mechanism in the form of a strap mechanism coupled to the support structure and extending across the embrasure. The strap mechanism urges the embrasure and load against each other and the support structure to thereby secure the load to the support structure.

9 Claims, 3 Drawing Sheets

LOAD CARRYING SYSTEM WITH FRICTION-ENHANCED LOAD CARRYING EMBRASURE

FIELD OF THE INVENTION

This invention relates to load caring systems generally of the type worn or otherwise carried by an individual user. More particularly, the present invention is directed to such a system which is specifically adapted to carry large awkward loads, such as skis or a snowboard. For the purpose of illustration herein, a preferred embodiment of the invention is illustrated and described in the setting of a user borne backpack—environment wherein the invention has been found to offer particular utility.

BACKGROUND OF THE INVENTION

Explaining, now, the background of this invention in the arena of backpack structure, skiers and snowboarders are often faced with the difficult task of transporting their equipment to and from the location where it is being used. Because of the length and weight of skis or snowboards, carrying such a load by hand can be rapidly fatiguing and an impediment to mobility and agility. This is particularly true where the person must hike some distance to reach the desired location. It is, therefore, generally more convenient to secure the skis or snowboard to the bearer's back.

With this in mind, many prior art user borne load carrying systems have been invented to secure skis or snowboards to a user's back. Such devices have typically suffered from a number of deficiencies. In particular, some prior art devices will carry only skis and not snowboards, or vice versa, and, generally, are not adaptable to carry a wide range of loads. Other devices do not hold the load securely enough, allowing it to swing about, which can be particularly dangerous where the user is attempting to negotiate challenging terrain. In some cases, the load may even slip out of the device. A portion of the instability found in many prior art load carrying systems may be traced to the low coefficient of friction between the load and the materials of which the system is constructed. In yet other devices, attaching and removing the load is overly difficult.

It is therefore an object of the present invention to provide a user bearable load carrying system which can be used effectively to secure an awkward load such as skis or a snowboard to an appropriate support structure, such as a backpack structure.

It is another object of the present invention to provide such a load carrying system that is readily adaptable to hold a wide variety of loads.

One more object of the present invention is to provide a user bearable load carrying system that holds a load sufficiently tightly to prevent shifting.

An additional object of the present invention is to provide a load carrying system of the type generally outlined that can quickly and easily secure a load.

SUMMARY OF THE INVENTION

The present invention is a user borne load carrying system comprising a support structure that is securable to, or otherwise carryable by, a user and a retention mechanism to secure a load to the support structure. The retention mechanism includes a girth-like embrasure of friction enhancing material adapted to encircle the load. The retention mechanism further includes an adjustment mechanism in the form of a strap mechanism coupled to the support structure and extending across the embrasure. The strap mechanism urges the embrasure and load against each other and the support structure thereby to secure the load to the support structure.

DETAILED DESCRIPTION OF THE PREFERRED EMBODIMENT

Figure 1:
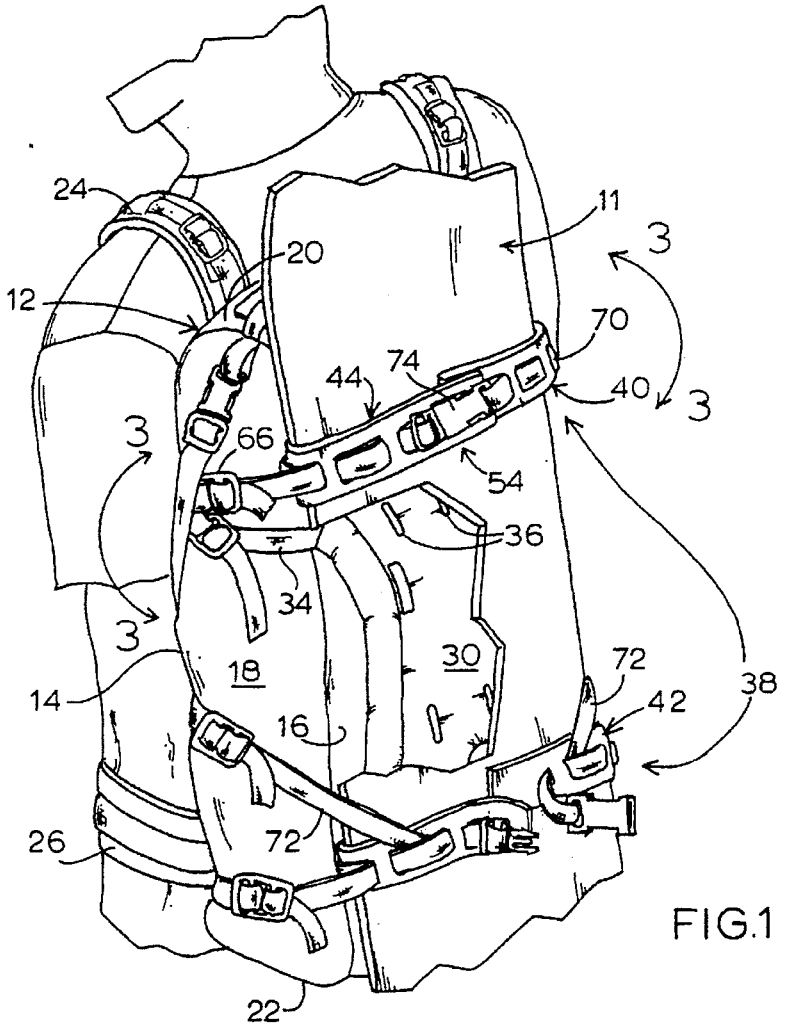
FIG. 1 is a rear perspective view of a backpack-type load carrying system according to the present invention.

A user borne load carrying system according to the present invention is shown generally at 10 in FIG. 1, and is illustrated in this figure in a condition carrying a snowboard 11, a portion of which has been broken away to reveal structural details which would otherwise be hidden. System 10 includes a support structure 12 which, in the preferred embodiment, is secured to a user and which takes the form of a backpack. Backpack 12 is of standard construction and includes a front side 14 that is disposed toward the user, an opposed back side 16 and two laterally opposed sides 18 (only one of which is seen in FIG. 1). The backpack also includes a top 20 and a bottom 22 and is secured to the user by shoulder straps 24 and a hip belt 26. It should be noted that relative orientations, such as above and below, will be specified assuming the backpack is positioned as it would be when mounted on an upright user.

Figure 2:
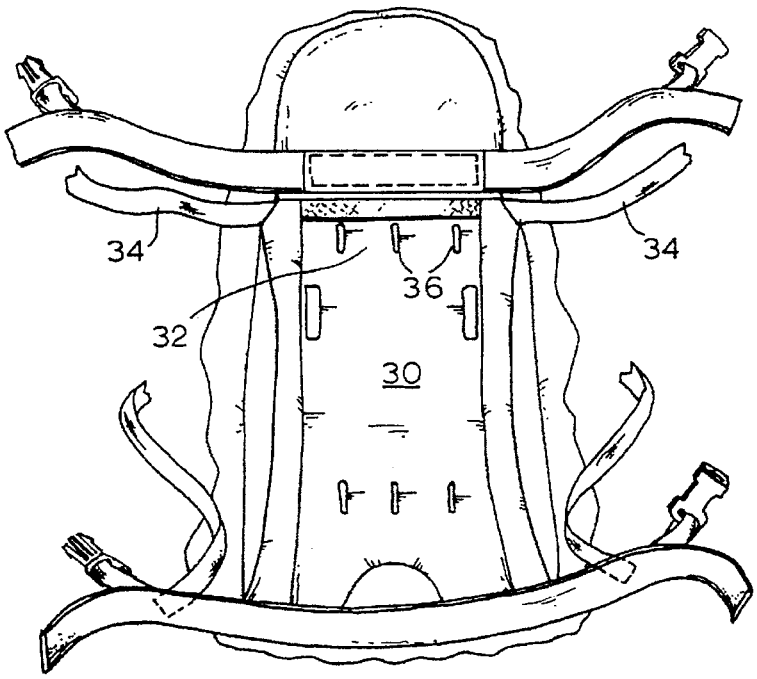
FIG. 2 is a reduced-scale, rear elevation of the load carrying system of FIG. 1 showing an expanse of friction enhancing material.
Figure 3:
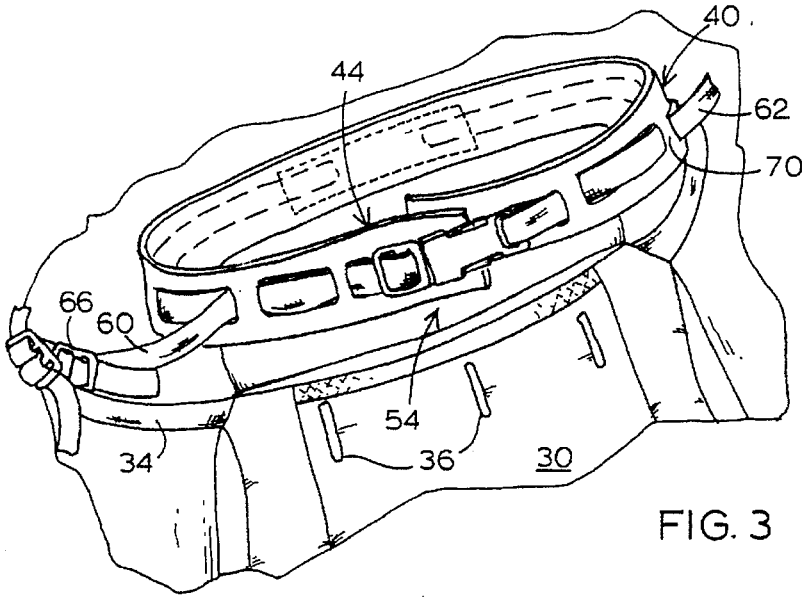
FIG. 3 is a fragmentary perspective view of an upper embrasure according to the present invention, with this view being taken generally in the region of FIG. 1 bracketed by curved double-headed arrows 3—3.

Considering now FIG. 2 along with FIG. 1, an expanse of friction enhancing material 30 (see the structure exposed by the broken-away portion of snowboard 11) is attached to backside 16 and covers a substantial portion thereof. Expanse 30 is permanently attached (as by stitching, for example) to backside 16 near bottom 22 and extends upwardly therefrom to an adjustable upper end 32 which is secured to backpack 12 by a pair of nylon straps 34 of adjustable length. This allows objects of varying size, such as snow shovels or ice axes, to be secured between the expanse and backside 16. Expanse 30 also includes a number of slots such as slots 36 through which straps can be run to secure various loads.

Figure 4:
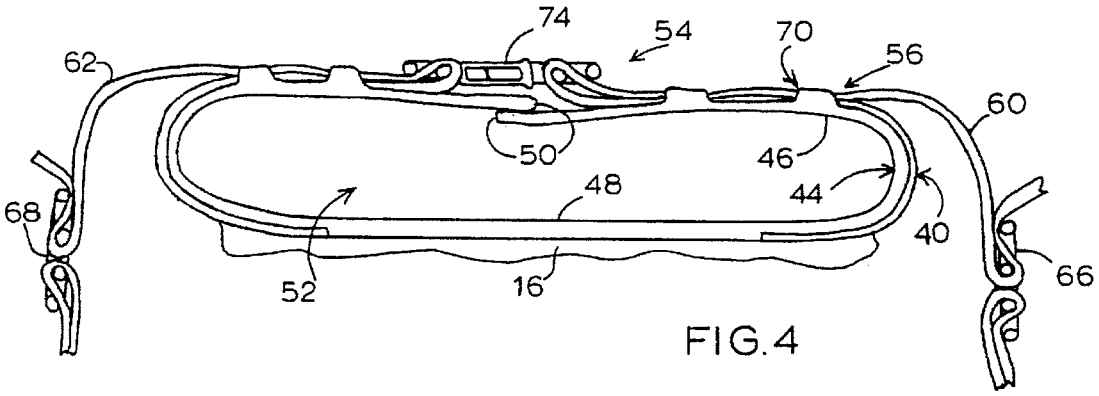
FIG. 4 is a top schematic view of the upper embrasure of FIG. 3 in a closed position.
Figure 5:
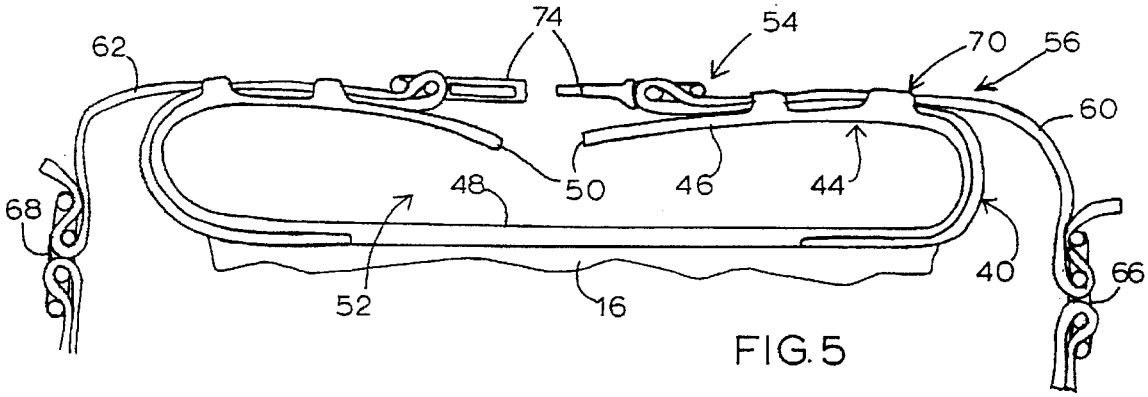
FIG. 5 is like FIG. 4 except that the pictured embrasure is in an open position.

A distributed retention mechanism 38 (see FIG. 1) is attached to backpack 12 to secure the load thereto. The retention mechanism includes upper and lower embrasures 40, 42 which are disposed adjacent the upper and lower ends, respectively, of expanse 30. The embrasures are openable and closeable to allow a load such as snowboard 11 to be inserted therein, as described below. Focusing attention now on FIGS. 4 and 5 along with FIG. 1, and addressing the common elements of each embrasure with specific reference to upper embrasure 40, each embrasure includes an organization of friction enhancing material in the form of a band-like load wrap 44 having an inner margin 46 which is urged into contact with a load to be carried. Because the wrap, and therefore the inner margin, are formed of a friction enhancing material, a load is securely gripped when the inner margin is urged into contact therewith.

The preferred friction enhancing material in the present invention is Hypalon™. Hypalon™ is a type of rubberized canvas material that is often used in the construction of rubber rafts. More generally, materials with an elastomeric surface or other materials having similar frictional properties should be suitable as friction enhancing materials for use in the present invention. The nylon straps traditionally used in backpacks have a relatively low coefficient of friction on the hard surfaces presented by skis or snowboards. Hypalon™, on the other hand, is quite grippy on such surfaces and therefore improves the stability of loads against which it is urged.

Each wrap includes a middle region 48 and opposed ends 50 on either side of the middle region. The wraps are secured to backside 16 at middle region 48, thereby leaving the opposed ends free. The free ends are used to form a horizontally oriented planar portal 52 of adjustable girth to encircle a load. The girth is adjusted by controlling the distance or overlap between the free ends of the wrap using an adjustment mechanism 54. When the wrap is drawn tightly about a load, the friction enhancing material in the wrap acts securely to grip the load, thus preventing the load from shifting in the wrap. Because the load is held securely by the wrap, and the wrap is fixed to the backpack so that it cannot shift relative thereto, the load, when encircled by the wrap, is held firmly in place on the backpack.

Adjustment mechanism 54 takes the form of a cinch 56 which extends across backside 16 over the load and embrasure. Cinch 56 takes the form of a strap mechanism having an elongate first strap portion 60 and an elongate second strap portion 62. The first and second strap portions are adjustably attached to the backpack near opposed sides, such as side 18, through first and second buckles 66, 68, respectively. The strap portions extend from their associated buckles 66, 68 to the proximal free ends of the associated wrap. The strap portions extend through a number of slots, such as slot 70 formed in wraps 44, and are thereby held in proximity to the wrap.

Figure 6:
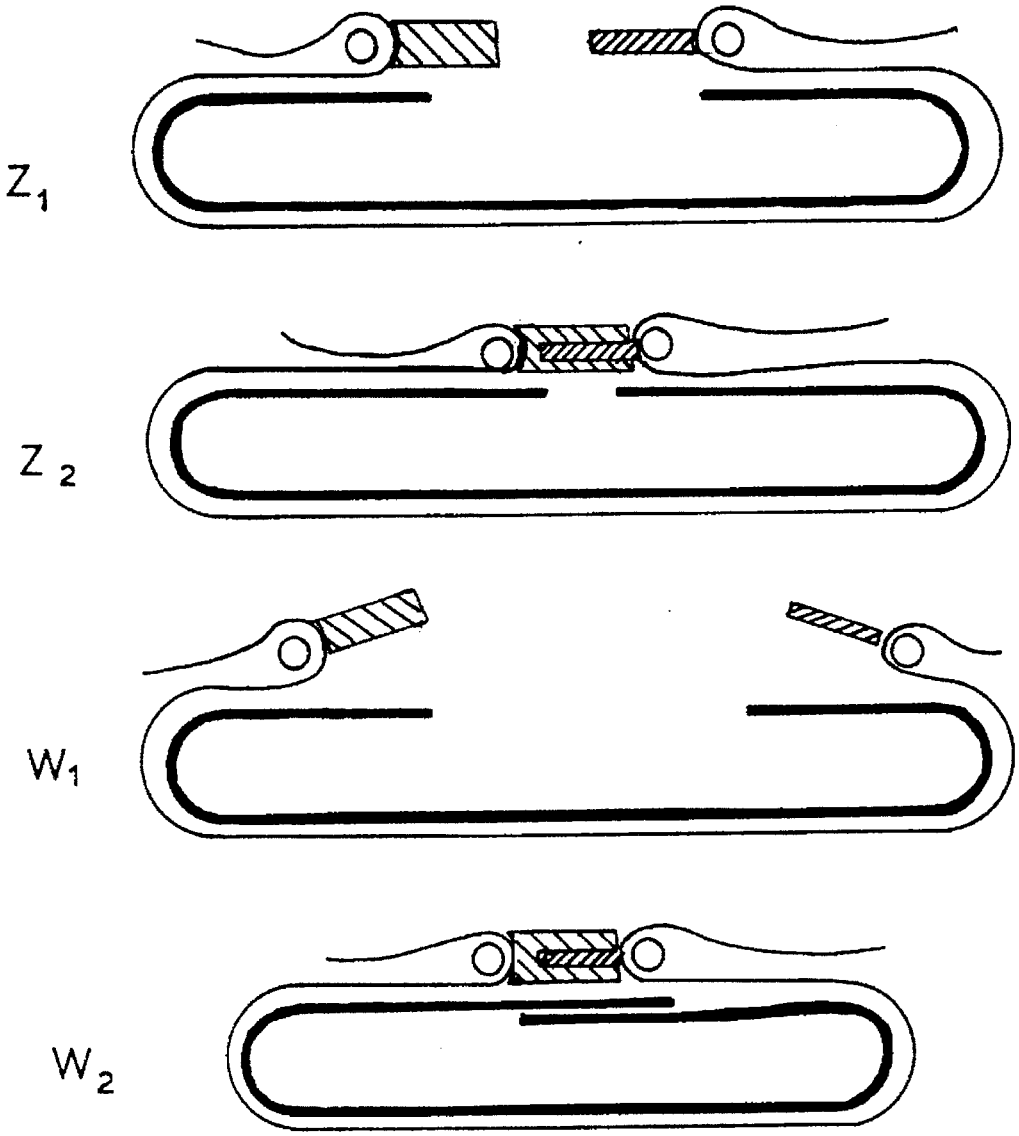
FIG. 6 is a schematic view of the upper embrasure of FIG. 3 illustrating how the girth of the embrasure is adjusted.

A male/female fastener pair 74 is slidably attached over the first and second strap portions near the associated free ends of the wrap. The strap portions then double-back through slots 70 and follow the wrap back to the middle region, where both the wrap and the strap portions are stitched to backside 16. By adjusting the position of the fastener pair on the strap portions, it is possible to adjust the girth of the portal to the desired size to accommodate a load when the fasteners are coupled to form a loop with the wrap. This process is illustrated in FIG. 6, where at $Z_1$ the fasteners are positioned on the strap portions beyond the ends of the wrap. As shown at $Z_2$, this results in a portal of large girth when the fasteners are coupled. On the other hand, when the fasteners are positioned on the straps behind the ends of the wrap in the open position, as shown at $W_1$, the portal resulting when the fasteners are coupled is much smaller, as shown at $W_2$. After the girth is adjusted to the appropriate size, the ends of the strap portions extending through the buckles are pulled to compress the embrasure and load against each other and expanse 30. The frictional interaction between the load and expanse 30, and between a load and the wraps, works to help prevent the load from shifting. Once the strap mechanism is adjusted, the fastener is simply opened and closed to mount or remove a load and no further adjustment is required.

Shifting focus particularly to FIG. 1, attached to lower embrasure 42 are two lift straps 72 of adjustable length extending between the free ends of the wrap in the embrasure and the lateral sides of backside 16 between the upper and lower embrasures. These lift straps help support heavy loads and prevent the embrasures from sagging.

A user borne load carrying system has been described that is adaptable to carry a wide variety of large, awkward loads. The system is easily loaded and unloaded and holds objects quite securely when loaded. Furthermore, the invented system is adaptable to many different backpack configurations and variations. Although a preferred embodiment of the invention has been described wherein the support structure takes the form of a backpack, it should be understood that many different types of support structures mounted to or carried by a user could incorporate the present invention.

It will now be clear that an improvement in this art has been provided which accomplishes the objectives heretofore set forth. While the invention has been disclosed in its preferred form, it is to be understood that the specific embodiment thereof as disclosed and illustrated herein is not to be considered in a limited sense as other forms or modifications will be apparent to those of skill in the art which should also be construed to come within the scope of the appended claims.

I claim:

1. A user borne load carrying system comprising:

a support structure securable to a user and having laterally spaced sides, and a rear expanse intermediate said sides wherein a load is adapted to be secured adjacent said rear expanse;

a strap mechanism operatively coupled to said support structure, said mechanism comprising a first strap portion having a first end portion connected to said structure at a first location adjacent one of said sides and a second end portion connected to said structure at a location intermediate said first and second sides and laterally spaced from said first location, and a second strap portion having a first end portion connected to said structure at a second location adjacent the other of said sides and a second end portion connected to said structure at a location intermediate said first and second sides and laterally spaced from said second location; and a fastener mechanism configured to selectively and releasably couple said first strap portion at a location along its length which is between said first and second end portions thereof in a substantially collinear relationship with said second strap portion at a location along its length which is between said first and second end portions thereof, thereby to form a loop extending across said expanse and the load.

2. The load carrying system of claim 1 further including a friction-enhancing load wrap disposed between at least a part of said loop and the load.

3. The load carrying system of claim 2, wherein said wrap includes a middle region and two free ends and said middle region is secured to said expanse and said free ends are configured to wrap around at least part way around the load.

4. The load carrying mechanism of claim 1, wherein said fastener mechanism includes first and second pieces slidably connected to each of said first and second strap portions, respectively, for movement along the length thereof and wherein said pieces are selectively joinable to one another to form said loop and to thereby allow the size of said loop to be adjusted.

5. The load carrying mechanism of claim 1 further comprising an expanse of friction enhancing material covering at least a portion of said read expanse adjacent said strap mechanism so that said strap mechanism is adapted to urge the load against said expanse of friction enhancing material.

6. The load carrying system of claim 1, wherein the lengths of said first and second strap portions are adjustable.

7. A user borne load carrying system comprising:

a support structure securable to a user and having laterally spaced sides, and, intermediate said sides, a rear expanse adjacent which a load is to be secured, the laterally spaced sides being configured to lie proximal to either side of the user's back;

a cinch coupled to the support structure at a first point adjacent one of the lateral sides and a second point adjacent the other of the lateral sides and extending therebetween across the rear expanse; and a load wrap including two elongate free end portions and a middle region disposed between and connecting the free end portions, with the load wrap being secured to the rear expanse only in the middle region and disposed generally between the first and second points and with the middle region having a length between the free end portions that is substantially less than the distance between first and second points, the free end portions thereby being free to extend away from the rear expanse adjacent the middle region and to turn back selectively toward one another to wrap the load disposed adjacent the rear expanse, with the load wrap being disposed between the cinch and the rear expanse so that tightening of the cinch urges the load wrap against the load and urges both the load and load wrap against the rear expanse.

8. The load carrying system of claim 7 further comprising an expanse of friction enhancing material covering at least a portion of the rear expanse adjacent the load wrap so that when the cinch is tightened the load is urged against the expanse of friction enhancing material.

9. The load carrying system of claim 7 further comprising a fastener mechanism configured to interrupt the portion of the cinch extending over the load wrap.

* * * * *